United States Patent [19]

Naito et al.

[11] Patent Number: 5,011,130

[45] Date of Patent: Apr. 30, 1991

[54] SHEET SORTER

[75] Inventors: Masataka Naito, Kawasaki; Masakazu Hiroi; Kimiaki Hayakawa, both of Yokohama, all of Japan

[73] Assignee: Canon Kabushiki Kaisha, Tokyo, Japan

[21] Appl. No.: 305,093

[22] Filed: Feb. 2, 1989

[30] Foreign Application Priority Data

Feb. 4, 1988 [JP] Japan ..... 63-25443

[51] Int. Cl.[5] ..... B65H 39/11

[52] U.S. Cl. ..... 271/288; 271/294

[58] Field of Search ..... 271/287, 288, 292–294, 271/298, 303, 304

[56] References Cited

U.S. PATENT DOCUMENTS 3,667,753 6/1972 Norton ..... 271/303
4,709,915 12/1987 Ishikawa et al. ..... 271/288
4,854,571 8/1989 Kitajima et al. ..... 271/293

FOREIGN PATENT DOCUMENTS 0161673 7/1987 Japan ..... 271/287

*Primary Examiner*—H. Grant Skeggs
*Attorney, Agent, or Firm*—Fitzpatrick, Cella, Harper & Scinto

[57] ABSTRACT

A sheet sorter includes first sheet discharging device for discharging sheet materials during non-sorting mode operation; second sheet discharging device for discharging sheet materials during sorting mode operation; a bin for the non-sorting mode operation; a plurality of bins for the sorting mode operation, a first bin of which is opposed to the second discharging device when the non-sorting bin is opposed to the first discharging device, wherein during the sorting mode operation, the plural bins are sequentially opposed to the second discharging device; and supporting device for supporting the non-sorting bin and the sorting bin with a predetermined positional relation to move them together.

6 Claims, 5 Drawing Sheets

SHEET SORTER

FIELD OF THE INVENTION AND RELATED ART

The present invention relates to a sheet sorter for sequentially receiving the sorting sheets such as copies and prints discharged from an image forming apparatus such as copying machine and printer, onto bin trays.

A sheet sorter provided with a sheet inlet for non-sorting operation and a sheet inlet for sorting operation is known.

For example, as shown in FIG. 1A, U.S. Pat. No. 4,709,915 issued on Dec. 1, 1987 and assigned to the assignee of this application discloses a sheet sorter which is provided with a non-sort sheet inlet defined by rollers *3a* and *3b* and a sort inlet defined by rollers *3c* and *3d*. In the sorting mode operation, the topmost bin tray 4-1 is opposed to the sheet inlet defined by the rollers *3c* and *3d*, and the bin trays are lifted stage by stage. During the non-sorting operation, the bin tray 4-1 is opposed to the sheet inlet defined by the rollers *3a* and *3b*.

In such a conventional apparatus, the first one 4-1 of the bins is used as both of non-sorting tray and a sorting tray. When the first bin 4-1 is placed opposite to the sort inlet (*3c, 3d*) (FIG. 1A), the first bin is moved to such a position wherein it is opposed to the non-sort inlet (*3a, 3b*) and is stopped there, if the mode is switched to the non-sort mode. Therefore, when the sheet sorter receives the first copy discharged from the image forming apparatus, the image forming apparatus has to pause and wait for the bins to move to the non-sort position, and therefore, it takes a relatively long time to take the first copy.

The reason why the two inlets respectively for the non-sorting operation and the sorting operation in the sorter is, for example, to improve the accessibility of the operator during the non-sorting operation.

If the sorter has only one inlet, the advantage can not be provided, as described in detail in U.S. Pat. No. 4,709,915.

Therefore, the present invention is related to problems peculiar to the sorter provided with at least two sheet inlets, and provides advantages not provided by another conventional apparatus wherein the first bin is used also as a non-sort bin.

SUMMARY OF THE INVENTION

Accordingly, it is a principal object of the present invention to provide a sheet sorter wherein the first copy can be taken quickly.

According to an embodiment of the present invention, when the non-sort bin or tray is opposed to the non-sort discharge outlet (conveying means) of an image forming apparatus, the first bin for the sorting mode operation is opposed to the sort discharge outlet (conveying means) of the image forming apparatus.

In this embodiment, the bins are not required to move in response to the switching between the non-sort mode operation and the sort mode operation, and therefore, the time required for the first copy produced from the image forming apparatus to be accommodated on the bin of the sorter (for example, the time required for the first copy to be completed) can be reduced, and therefore, the first copy may be obtained quickly.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
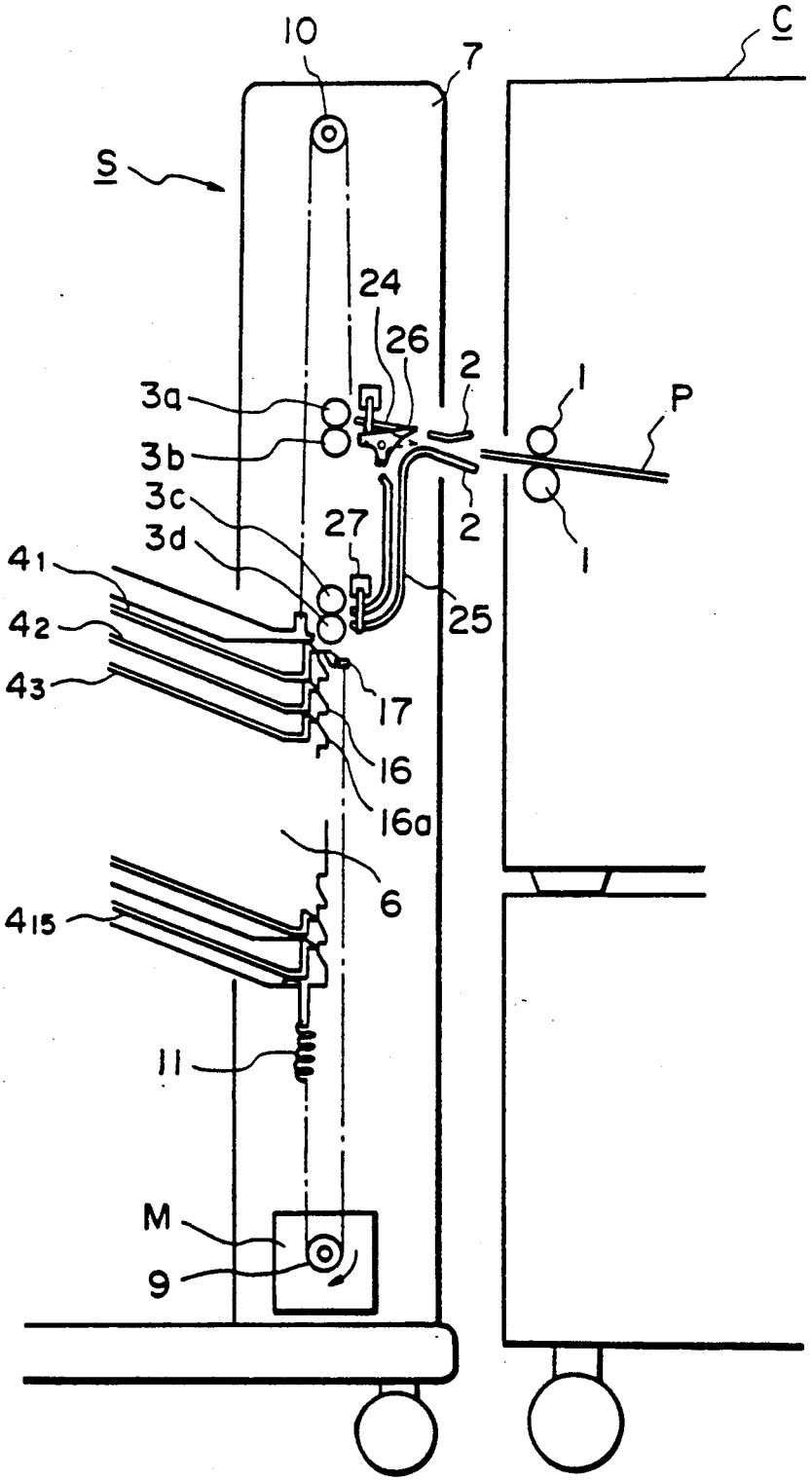
FIG. 1A PRIOR ART
FIG. 1A and FIG. 1B are sectional views of a conventional sheet sorter.
Figure 1B:
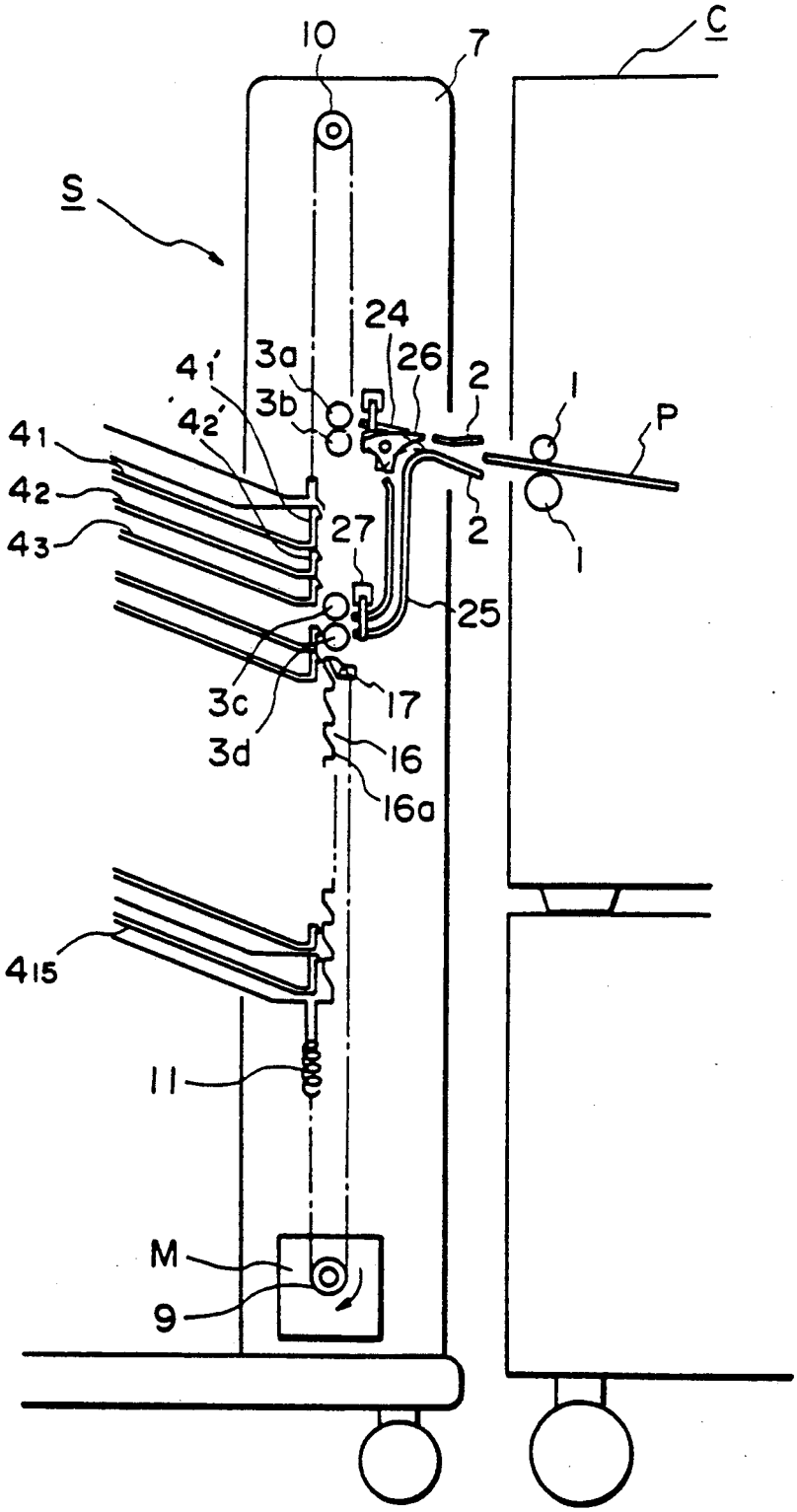
FIG. 1B PRIOR ART
Figure 2:
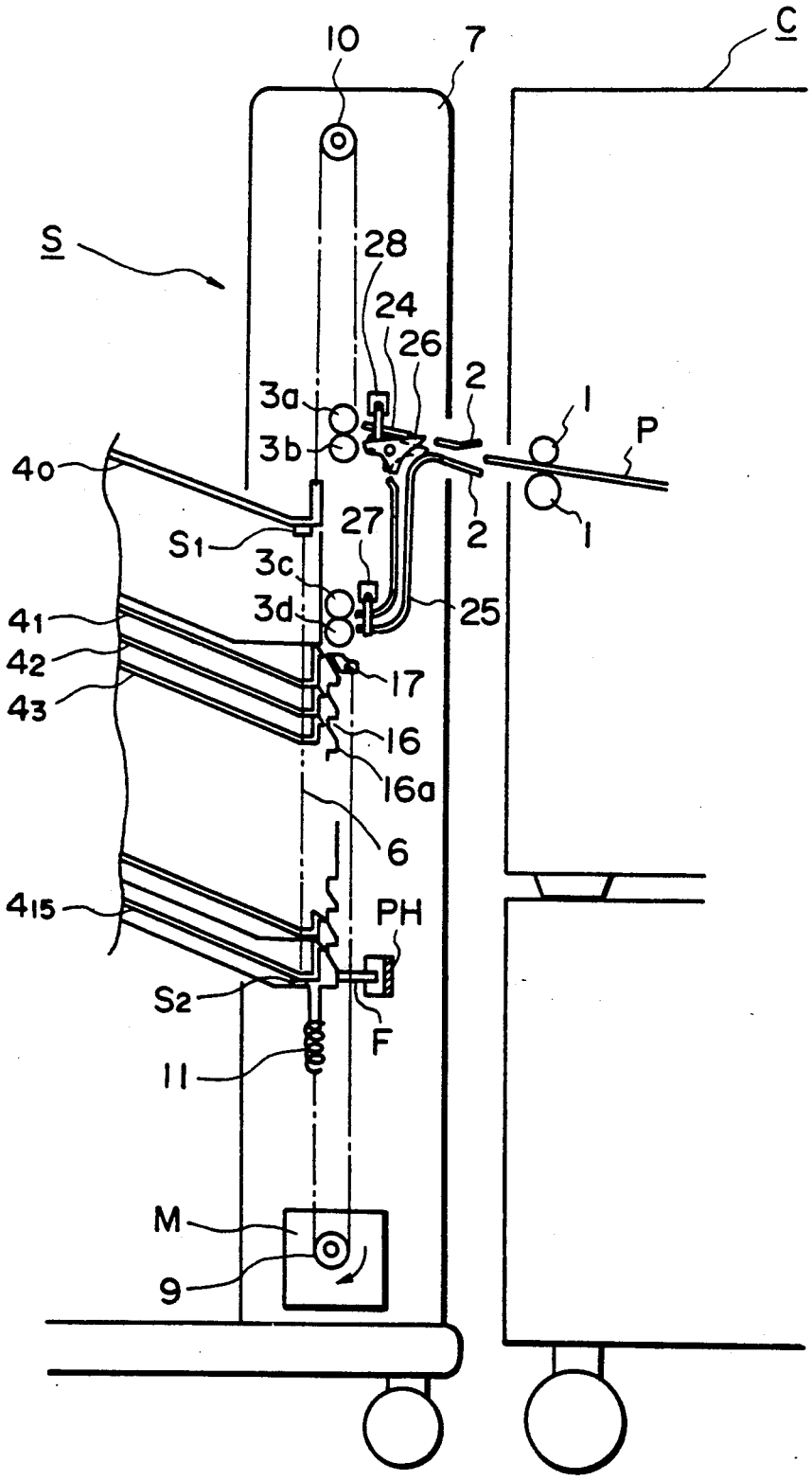
FIG. 2 is a sectional view of a sorter according to an embodiment of the present invention.

Referring to FIG. 2, there is shown a sheet sorter according to an embodiment of the present invention.

Generally, a sorter is provided with 10–20 or more sheet stacking trays which will hereinafter be called "bin". The bins sequentially receive in a sorted manner, the sheets continuously discharged from a copying machine or the like at regular time intervals. A sheet P discharged by a pair of discharging rollers 1 and 1 of a copying machine C is introduced into a sheet inlet of a sorter S attached to the copying machine C. The sheet P is directed to the conveying rollers *3a, 3b, 3c* and *3d* by inlet guides 2 and 2. Opposed to the conveying rollers *3a* and *3b* constituting a sheet inlet of the sorter, a non-sort bin (or a top cover of the bin unit) $4_0$ is disposed, whereas a sorting bin $4_1$ is faced to a sheet inlet of the sorter S defined by a pair of conveying rollers *3c* and *3d*. The position of the sorter S shown in this Figure is a home position, in which the above-described relations are satisfied with this home position.

The home position is detected by a combination of a flag F mounted on the bin unit and a photosensor mounted on a sorter post 7.

In this embodiment, 15 bins $4_1, 4_2, \ldots, 4_{15}$ are provided. Each of the bins, except for the topmost bin $4_1$ and the bottommost bin $4_2$, are supported on bin supporting plate 5 for substantially vertical inclining movement at their lateral sides (front side and rear side of the drawing). As for the means for opening the inlet side of each of the bins, known means is usable, but an example is shown in FIG. 3.

Figure 3:
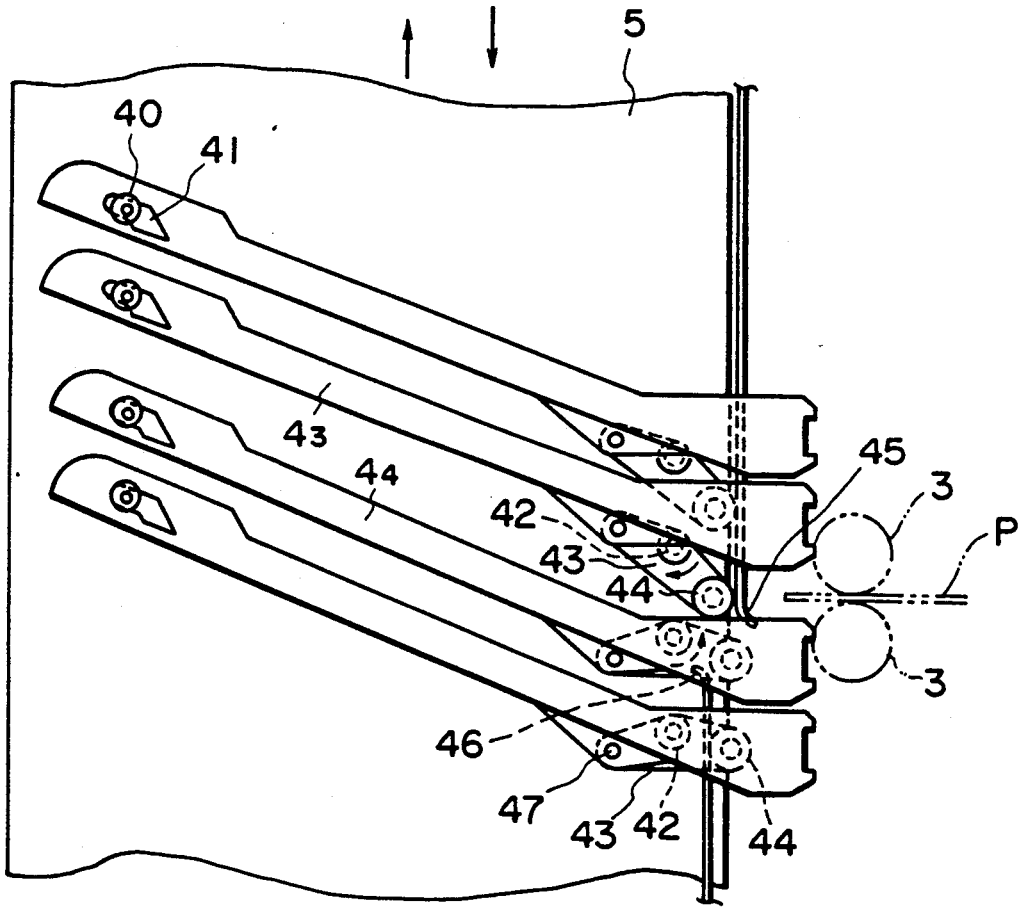
FIG. 3 is an enlarged top plan view of a part of an apparatus.

Referring to FIG. 3, the rear side (left side in the Figure) of the bin is supported by slidable engagement between an elongated slot 41 of the bin and a pin 40 mounted on the supporting plate 5. At the inlet side (right side) of the bin a lever 43 is mounted to each of the bins. The lever 43 has a pin 42 mounted to the supporting plate 5. An end of the lever is mounted to the bin by a pin 47, and the lever 43 is provided with a roller 44 at the free end. A cam plate 45 is effective to expand the inlet for the bin when the bins are moved upwardly as a whole, whereas a cam plate 46 is effective to return the bin during the downward movement of the bins. The cams are separated at a level of the conveying rollers *3c* and *3d*.

When the bins are moved upwardly together with the supporting plate 5, as shown in FIG. 3, the roller 44 mounted to the bin $4_3$ is abutted to the cam plate 45 so that the lever 43 pivots in the clockwise direction about the pin 42 to raise the inlet side of the bin $4_3$ in addition to the amount of upward movement of the supporting plate 5. Therefore, the sheet inlet space for the lower adjacent bin $4_4$ is expanded so that the bin $4_4$ can receive the sheet with the wider space.

When the bin lowers from the state shown in FIG. 3, the roller 44 of the bin $4_3$ placed at an upper position by the cam plate 45 is disengaged from the cam plate 45 and is brought into contact with a returning cam 46. By this, the lever 43 is rotated in the counterclockwise direction to lower the inlet side of the bin $4_3$ to its original position. Referring back to FIG. 2, a motor M is disposed below the post 7 and is provided with an output shaft having a gear 9. A chain or wire 8 is trained around the gears 9 and 10 provided at an upper portion of the post. An end of the chain is mounted to an upper position of the supporting plate 5, and the other end is connected to a lower end of the supporting plate through a coil spring 11 absorbing a shock imparted by movement of the bins. Therefore, by driving the motor M in the clockwise direction in this Figure, the group of bins $4_1 \ldots 4_{15}$ are moved upwardly together with the supporting plate 5.

The supporting plate 5 moves substantially vertically along the post 7 at least through a distance corresponding to a distance from the topmost bin $4_1$ to the bottommost bin $4_{15}$.

The sheet material P discharged from the copying machine C during the sorting mode, is received by a bin faced to the conveying rollers 3*c* and 3*d* by the guides 2 and 2 of the sorter and the conveying rollers 3*c* and 3*d*. In response to a detection signal indicative of accommodation of the sheet on the bin, the supporting plate 5 supporting the bins is lifted so that the sheet inlet of the next lower bin is raised to be opposed to the conveying rollers 3*c* and 3*d*. With this state, the bin waits for the reception of the next sheet material. By repeating the above operations, the bins $4_1 \ldots 4_{15}$ sequentially receive the sheets P.

Figure 4:
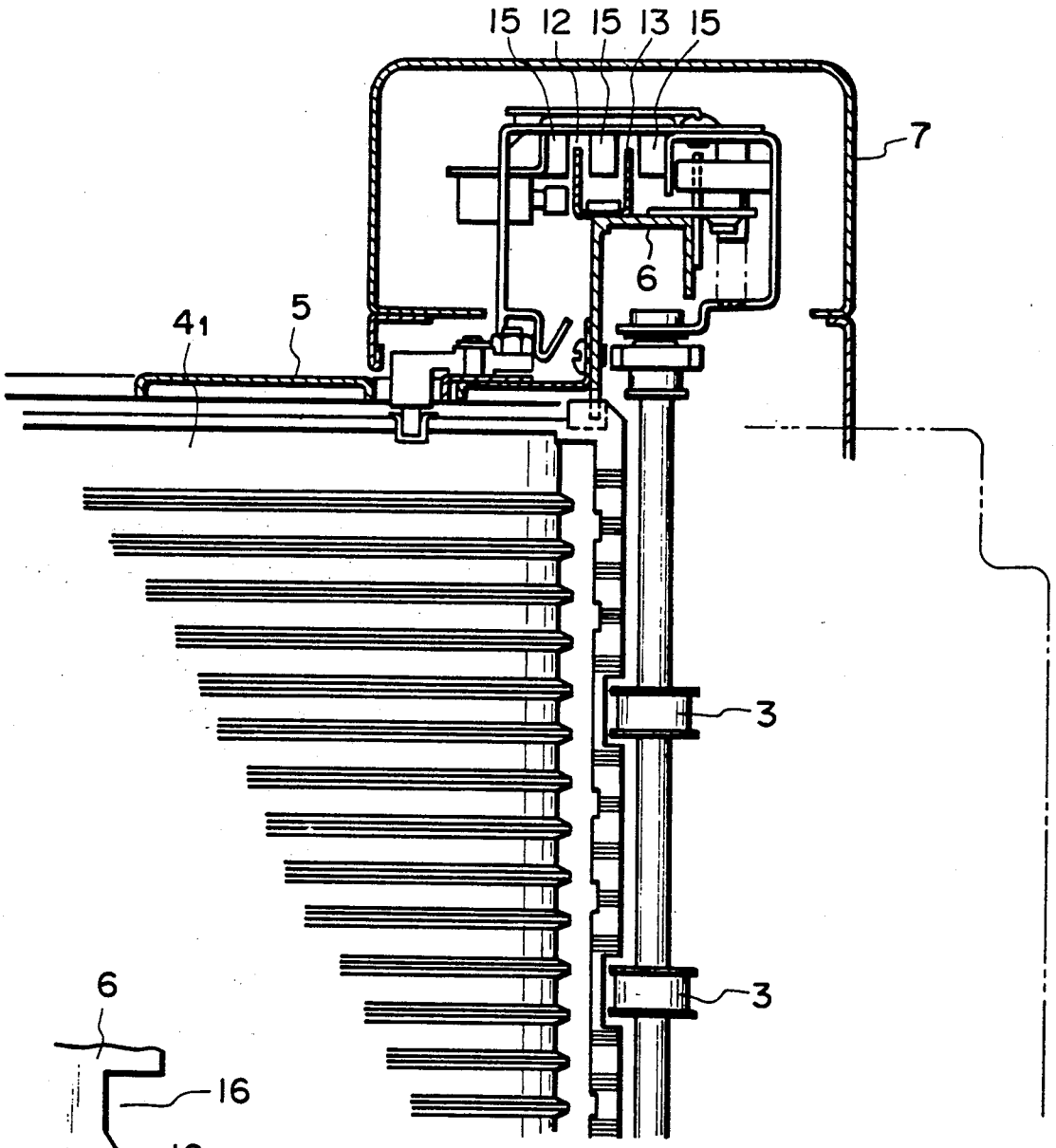
FIG. 4 is an enlarged front sectional view of a part of a group of trays or bins.

FIG. 4 is an enlarged top plan view of the sorter post 7. In the post 7, a plate 13 having a cut away portion is fixed to a vertical movable member 6 integral with the supporting plate 5. The plate 13 functions as means for positioning the bins so that they move up and down along the groove 12. The plate 13 has cut away portions at such positions corresponding to the interval between bins. The cut away portion transmitting light is detected by a position detecting sensor 15 comprising a light emitting element and a light receiving element. In response to the detection signal, the motor M is stopped to actuate an electromagnetic brake not shown, so that the stop position of the bin is determined.

Figure 5:
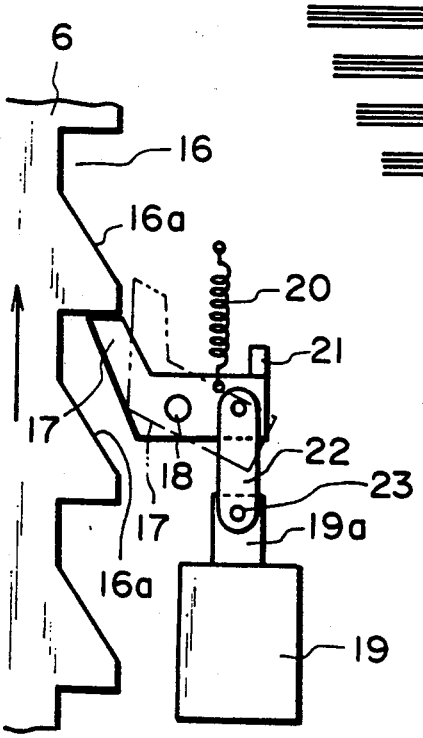
FIG. 5 is an enlarged front view of a fall-preventing.

FIG. 5 shows an enlarged view of a part of the vertical movable member 6, illustrating in detail a mechanical for fall prevention. As shown in this Figure, the movable member 6 is provided with cut away portions 16 at such positions that the bin inlet portion and the nip between the conveying rollers 3*c* and 3*d* are aligned. A pawl 17 is selectively engageable with the cut away portions 16 and is rotatably supported by a shaft 18. During the upward movement of the bin, the pawl 17 is pushed by the inclined surface 16*a* of the cut away portion 16 and is retracted to the chain line position against the spring force of the spring to permit upward movement of the bin unit. The pawl 17 is connected with a plunger 19*a* of a retracting electromagnetic mechanism 19 by a pin 23 through a linkage 22. A stopper 21 contactable to the pawl 17 is mounted at a spring 20 stretching side.

By the fall prevention mechanism described above, even if, for example, the electromagnetic brake supporting the bins at upper positions becomes in operative by power failure or the like, the pawl 17 is brought into engagement with the cut away portion 16 to safely prevent the bins from falling by the weight. When the bins are to be returned to the initial bottommost position, the electromagnetic mechanism 19 is energized so that the pawl 17 is rotated to the chain line position, thus disengaging it from the cut away portion 16.

Next, the operation will be described. In a certain type of sorter, as disclosed in copending U.S. patent application U.S. Ser. No. 304,489 filed Feb. 1, 1989 and assigned to the assignee of the assignee of the present application claiming the Convention Priority of Japanese Patent Applications Nos. 023126/1988 (filed on February, 1988) and 207167/1988 (filed on Aug. 19, 1988), the sorter S is returned to its home position (the bottommost position), in response to removal of the sheets from the bins, which removal is detected by a bin penetrating sensors S1 and S2 (FIG. 2).

As described hereinbefore, when the bin unit is at the home position, the conveying means 3*a* and 3*b* for the non-sorting operation and the non-sorting tray $4_0$ are substantially aligned, and simultaneously, the conveying means 3*c* and 3*d* for the sorting operation and the first sort bin $4_1$ are aligned. Therefore, even if the operator inputs the selection between the nonsorting mode or the sorting mode, the bin unit is not required to move. Thus, the first copy discharged by the image forming apparatus can be accommodated by a predetermined bin (non-sort bin or sorting bin) for a short period of time.

During the non-sorting mode operation, for example, the deflector 26 is placed at a position indicated by broken lines in FIG. 2, and the sheet conveyed from the inlet guide 2 is discharged on the bin $4_0$ by the conveying rollers 3*a* and 3*b* through the non-sort passage 24. The discharge of the sheet onto the bin $4_0$ is detected by the sensor 28.

In the sort mode operation, the deflector 26 is placed at a solid line position (FIG. 2) which is switched to this position in response to selection of the sorting mode. The sheet material is discharged onto the first bin $4_1$ of the sort bins by the conveying rollers 3*c* and 3*d* through the guide (sorting passage) 25. Each time the discharge of the sheet is detected by the sensor 27, the motor M rotates in the clockwise direction so that the bin is raised stage-by-stage.

The bin exclusively for the non-sort mode may be similar to the sort bin, or it may be in the form of a top cover of the bin unit so that the top cover functions as one of the bins.

With this structure, the image forming apparatus does not wait for the preparation of the sorter (movement of bins) for the first copy to be discharged from the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A sheet sorter for use with an apparatus having a sorting mode and a non-sorting mode, said sorter comprising:

first sheet discharging means for discharging sheet materials exclusively during operation in said non-sorting mode;

second sheet discharging means for discharging sheet materials during operation in said sorting mode;

a single bin for receiving sheet materials from said first sheet discharging means during operation in the non-sorting mode;

a plurality of bins for use during the sorting mode operation, a first bin of said plurality of bins being single bin is opposed to said first sheet discharging means;

wherein during operation in the sorting mode, the plural bins are sequentially opposed to said second sheet discharging means; and supporting means for supporting said single bin and said sorting bin with a predetermined positional relation to move them together.

2. A sorter according to claim 1, wherein said first sheet discharging means and said second sheet discharging means are vertically spaced, and wherein said supporting means moves substantially vertically.

3. A sorter according to claim 2, wherein said first sheet discharging means being located above said second sheet discharging means, and wherein said single bin is above said plurality of sorting bins.

4. A sorter according to claim 2, wherein said single bin is supported on said supporting means, and the plural sorting bins are swingably supported to expand adjacent bins with interrelation with the vertical movement of said supporting means.

5. An apparatus according to claim 4, wherein sheet passages upstream of said first sheet discharging means and said second discharging means with respect to movement of the sheet are merged, and a deflector for selecting either of the passages is provided.

6. An image forming apparatus having a sorting mode and a non-sorting mode, said apparatus comprising:

an image forming station;

first sheet discharging means for discharging sheet materials on which images are formed by said image forming station, exclusively during operation in the non-sorting mode;

second sheet discharging means for discharging sheet materials on which images are formed by said image forming station, during operation in the sorting mode;

a single bin for receiving sheet materials from said first sheet discharging means during operation in the non-sorting mode;

a plurality of bins for use during the sorting mode operation, a first bin of said plurality of bins being opposed to said second sheet discharging means when said single bin is opposed to said first sheet discharging means;

wherein during operation in the sorting mode, the plural bins are sequentially opposed to said second sheet discharging means; and supporting means for supporting said single bin and said sorting bin with a predetermined positional relation to move them together.

* * * * *

UNITED STATES PATENT AND TRADEMARK OFFICE

CERTIFICATE OF CORRECTION

PATENT NO. : 5,011,130

DATED : April 30, 1991

INVENTOR(S) : Masataka NAITO et al.

It is certified that error appears in the above-identified patent and that said Letters Patent is hereby corrected as shown below:

COLUMN 5

Line 10, "being" should read --being opposed to said second sheet discharging means when said--.

Signed and Sealed this

Sixth Day of October, 1992

*Attest:*

DOUGLAS B. COMER

*Attesting Officer*

*Acting Commissioner of Patents and Trademarks*